US007434534B2

(12) United States Patent
Erskine et al.

(10) Patent No.: US 7,434,534 B2
(45) Date of Patent: Oct. 14, 2008

(54) FASTENER FOR A BOAT COVER

(75) Inventors: Edward J. Erskine, Benson, NY (US); Eric S. Butler, Sloansville, NY (US); Douglas D. Griffith, Speculator, NY (US)

(73) Assignee: Taylor Made Group, Inc., Gloversville, NY (US)

( * ) Notice: Subject to any disclaimer, the term of this patent is extended or adjusted under 35 U.S.C. 154(b) by 0 days.

(21) Appl. No.: 11/673,760

(22) Filed: Feb. 12, 2007

(65) Prior Publication Data

US 2008/0190349 A1 Aug. 14, 2008

(51) Int. Cl.
*B63B 17/00* (2006.01)
*B60J 1/02* (2006.01)

(52) U.S. Cl. ..... 114/361; 296/96.21

(58) Field of Classification Search ..... 114/361
See application file for complete search history.

(56) References Cited

U.S. PATENT DOCUMENTS 2,937,652 A 5/1960 Zimmer, Jr. et al.
2,961,725 A 11/1960 McGee
3,016,548 A 1/1962 Taylor
3,172,419 A 3/1965 Lewis
3,192,542 A 7/1965 Mills, II
3,245,182 A * 4/1966 Zierold ..... 52/208
3,367,349 A 2/1968 O'Link
3,533,890 A 10/1970 Nesbit
4,287,657 A 9/1981 Andre et al.
4,692,969 A 9/1987 Johnson
4,730,866 A 3/1988 Nett
4,838,602 A 6/1989 Nett
4,850,640 A 7/1989 Gold
4,986,594 A 1/1991 Gold et al.
5,339,763 A 8/1994 Erskine

* cited by examiner

*Primary Examiner*—Jesús D Sotelo
(74) *Attorney, Agent, or Firm*—Nixon & Vanderhye P.C.

(57) ABSTRACT

A trim assembly for a windshield includes a trim piece extendable along an edge of the windshield and a gasket secured within the trim piece and including a first channel for receiving the edge of the windshield and a second channel separate from the first channel. A fastener clip is secured in the second channel of the gasket and includes one part of a releasable fastener. By providing a dedicated channel for receiving the fastener clip, a more secure connection can be achieved.

16 Claims, 2 Drawing Sheets

Fig. 1
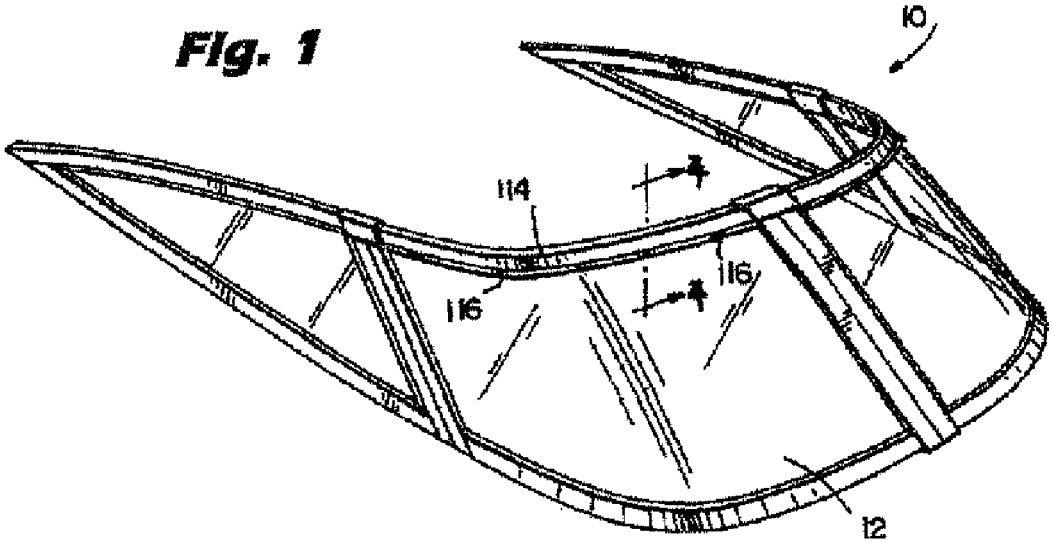
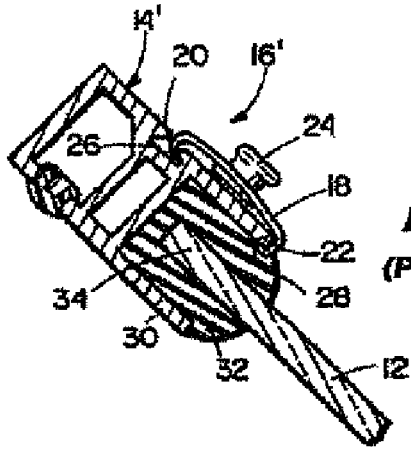
Fig. 2
(PRIOR ART)
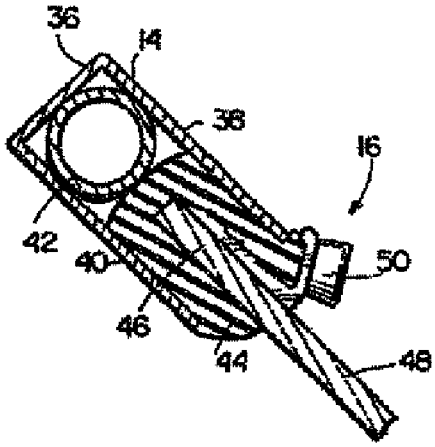
Fig. 3
(PRIOR ART)

FASTENER FOR A BOAT COVER

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

This invention relates generally to fasteners for attaching canopies of fabric coverings to objects or vehicles which are to be protected from wear or from inclement weather. More specifically, the invention relates to fastener clips for attachment to the exposed edge of a boat windshield by which a flexible top or removable cover may be secured to the windshield.

As is well known, many pleasure boats today have windshields that project upwardly from the gunwales and front deck of the boat. The exposed edges of the windshield are typically comprised of a protective trim usually of vinyl, aluminum or stainless steel construction. Most boats of this type also have flexible tops or removable covers to protect the boat when it is not in use or during inclement weather. These covers or tops are typically formed of a flexible material such as canvas or other waterproof fabric, and are fastened to the exposed edge of the windshield by conventional fastener means. In many windshield constructions, fasteners are attached directly to the windshield trim at spaced locations along the upper edge of the windshield. Each fastener clip mounts a conventional fastener, such as a male snap fastener component, that is designed to mate with a corresponding female component that is affixed to the flexible top or removable cover.

The patent literature contains many examples of fastener clips which are adapted for securement to the trim pieces of the exposed edge of a boat windshield. In U.S. Pat. No. 4,692,969, for example, a windshield attachment clip mounting a snap fastener is disclosed which has a generally inverted U-shape which simply snaps over the trim piece. The snap fastener component is secured to an extended leg portion of the clip.

In U.S. Pat. No. 3,367,349, conventional snap buttons are attached to a boat windshield trim piece with inwardly turned legs of a web portion of an associated clip which is apparently secured within spaced grooves formed in the trim piece.

In U.S. Pat. No. 2,961,725, boat windshield clips are disclosed which include right angled strap portions which fit over the windshield trim piece, one of the strap portions mounting a conventional, snap fastener component.

In U.S. Pat. No. 2,937,652, spring clips are disclosed which are designed to snap over the outer face of the windshield trim strip. Each spring clip mounts a conventional male snap fastener component.

In each of the above described arrangements, the fastener clips are designed for attachment directly to the trim piece or strip which covers the exposed edge of the boat windshield. As such, the fastener clips present a cluttered and unsightly appearance which otherwise detracts from the smooth, stream-lined design of the windshield.

In the prior art construction shown in FIG. 2, the trim piece 14' has fixed thereto along its length, a plurality of snap fastener clips 16'. Each clip 16' includes a relatively flat base portion 18 and a pair of inwardly turned flanges 20 and 22 as well as an integral male snap fastener 24 secured generally in the middle of the base portion 18 by any suitable means such as riveting or the like. The inwardly turned flange 20 is seated within a dovetail-like groove 26 formed in the trim piece 14', while the opposite inwardly turned flange 22 is secured about the edge of a flange portion 28 of the same trim piece. A laterally spaced flange portion 30, in combination with flange portion 28, define a space for receiving a generally inverted U-shaped gasket 32 (constructed of conventional gasket material) which sandwiches and seals the edge portion 34 of the glass 12. As can be seen in FIG. 2, the upper edge 34 of the glass along with the gasket 32 are slidably received within the space defined by the flange portions 28 and 30 of the trim piece 14'.

As will be appreciated from FIG. 2, a series of such clips 16' arranged along the windshield presents an unsightly appearance which detracts from the otherwise streamlined look of the windshield assembly as a whole.

An improvement over the FIG. 2 design is shown in FIG. 3 and is the subject of U.S. Pat. No. 5,339,763, the contents of which are hereby incorporated by reference. The windshield assembly is shown to include a trim piece 14 and associated snap fastener clip 16 of the type illustrated in FIG. 1. More specifically, the trim piece 14 is a channel-shaped member including a base portion 36 and a pair of flange portions 38 and 40 which extend in substantially parallel but laterally spaced relationship away from the base portion 36. A tubular trim piece 42 extends within the trim piece 14, adjacent the base portion 36, leaving sufficient space to receive the generally inverted U-shaped gasket 44 which, in turn, seals the upper edge 46 of the glass 48 within the trim piece 14.

The fastener clip 16, including a snap fastener 50 in this prior design, is secured in the gasket in direct contact with the glass. That is, the fastener clip 16 is attached to the windshield assembly 10 by pushing its longer leg portion between the gasket 44 and the glass such that the smooth or flat exterior surface of the leg portion lies flush against the glass 48, while serrations formed on the inside surface of the leg portion are effectively embedded within the gasket 44. Ramp surfaces allow the edge of the gasket to lie flat on the glass.

A problem arises with this design however, in that the smooth surface of the glass does not contribute to holding the clip in position when the boat top is pulled off in a direction parallel to the length of the top trim (other than to apply a force that drives the serrations into the gasket). During normal operations, the clip adequately stays in place, but during a more aggressive canvas removal, the clips sometimes shift sideways.

Moreover, the snap being in such close proximity to the glass makes it more difficult to accommodate the fold of canvas at the top edge. Many tops have canvas material past the line where the snaps are inserted. That extra canvas must fold when it gets to the glass. If the canvas is very thick, the fold pressing against the glass can release the snap.

Still further, the snap being in such close proximity to the glass makes it more difficult to install and uninstall the top. It is more difficult to get fingers under the edge of the canvas. Sometimes when snapping on the top, a thumb tip hits the glass before the snap seats.

Another problem with the prior design is that with the snap in such close proximity to the glass, the snap is visible from the inside of the boat, which some consider unsightly.

The tab disrupting the seal of the gasket to the glass can also allow water into the gasket channel, where it can travel along in search of a way into the boat.

BRIEF SUMMARY OF THE INVENTION

If would be desirable to provide a fastener clip that does not attach directly to the windshield trim piece so that a smooth, uninterrupted surface along the entire length of the trim piece is achieved. To this end, the fastener clips described herein are attached along a gasket in a designated channel. In addition, the fastener clips are constructed of black material which blends with the black material of the gasket so that the fastener clips are virtually unnoticeable. It would also be desirable to provide a fastener clip that overcomes the problems of the prior design.

In an exemplary embodiment of the invention, a trim assembly for a windshield includes a trim piece extendable along an edge of the windshield and a gasket secured within the trim piece and including a first channel for receiving the edge of the windshield and a second channel separate from the first channel. A fastener clip is secured in the second channel of the gasket and includes one part of a releasable fastener such as a snap. The first channel and the second channel preferably initiate on a windshield side of the gasket and extend into the gasket. In one embodiment, the fastener clip includes first and second legs disposed at an angle to each other, with the first leg being insertable into the second channel in the gasket. In this context, the one part of the releasable fastener is affixed to the second leg. The first leg preferably includes a plurality of serrations on at least one side thereof.

In another exemplary embodiment of the invention, a boat windshield assembly includes a transparent member; at least one trim piece extending along an edge of the transparent member; a gasket secured within the trim piece and including a first channel for enclosing the edge of the transparent member and a second channel separate from the first channel; and a fastener clip secured in the second channel of the gasket and including one part of a releasable fastener.

In yet another exemplary embodiment of the invention, a top trim assembly for a windshield includes a trim piece defining a gasket receiving channel and a gasket insertable into the gasket receiving channel. The gasket includes a first channel for enclosing the edge of the windshield and a second channel separate from the first channel. A fastener clip includes first and second legs disposed at an angle to each other. The first leg is insertable into the second channel in the gasket, and one part of a releasable fastener is affixed to the second leg. The second leg and the one part are configured such that the one part is accessible when the first leg of the fastener clip is inserted into the second channel.

BRIEF DESCRIPTION OF THE DRAWINGS

These and other aspects and advantages of the present invention will be described in detail with reference to the accompanying drawings, in which:

FIG. 1 is a perspective view of a boat windshield assembly incorporating a snap fastener clip;

FIGS. 2 and 3 are partial cross sectional views of an upper windshield trim piece having a known snap fastener clip attached thereto;

DETAILED DESCRIPTION OF THE INVENTION

With reference to FIG. 1, a boat windshield assembly 10 includes various trim pieces (typically constructed of plastic, aluminum or stainless steel), which are attached to the edges of the glass or other transparent material 12. An upper windshield edge trim piece 114 is shown with associated snap fastener clips 116. As discussed above, the snap fastener clips are typically used to secure a flexible top or removable cover (e.g., a canvas tarp or the like) over the otherwise open seating area.

Figure 4:
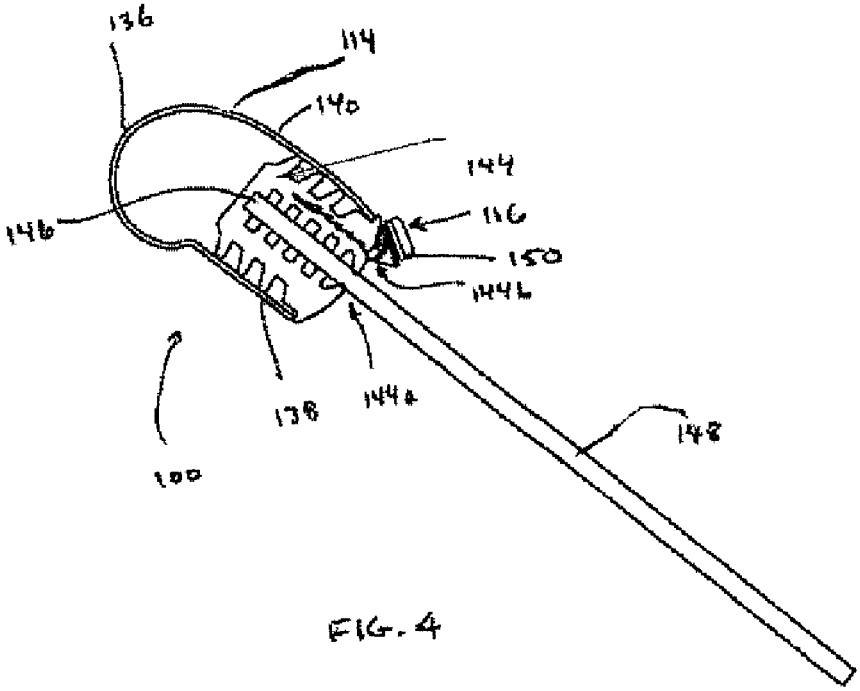
FIG. 4 is a partial cross sectional view taken along the line 4-4 of FIG. 1 and illustrating the snap fastener clip construction described herein.

As shown in FIG. 4, the improved trim assembly 100 includes a channel shaped trim piece 114 including a base portion 136 and a pair of flange portions 138 and 140, which extend in substantially parallel but laterally spaced relationship away from the base portion 136. A generally inverted U-shaped gasket 144 includes a first channel 144*a* that seals the upper edge 146 of the glass 148 within the trim piece 114. The gasket 144 also includes a second channel 144*b* separate from the first channel 144*a*.

Figure 5:
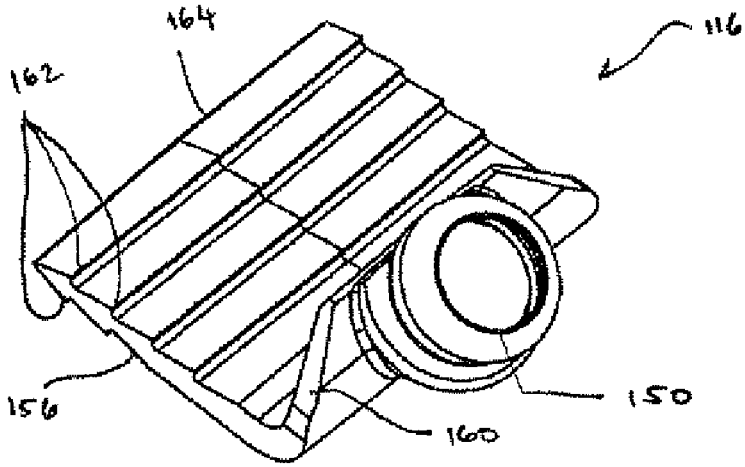
FIG. 5 is a perspective view of the snap fastener clip shown in FIG. 4.

With continued reference to FIG. 4 and with reference to FIG. 5, a fastener clip 116 includes first and second legs 156, 160 disposed at an angle to each other. The first leg 156 is insertable into the second channel 144*b* in the gasket 144. One part 150 of a releasable fastener such as a snap assembly is affixed to the second leg 160. The one part 150 may be integral, e.g., via molding or the like, with the second leg 160. The one part 150 may be either a male snap fastener or a female snap fastener of a snap assembly or may alternatively be a portion of another type of releasable fastener. Preferably, the first leg 156 is longer than the second leg 160 and includes a plurality of serrations 162 on at least one surface thereof. As shown, a number of serrations 162 are provided on each side of the first leg 156. The free end of the first leg 156 has a generally tapered edge 164 to facilitate insertion into the second channel 144*b* of the gasket 144. In the configuration shown in FIG. 4, the second leg 160 and the one part 150 are configured such that the one part 150 is accessible when the first leg 156 of the fastener clip 116 is inserted into the second channel 144*b*.

The snap fastener clip 116 may be constructed of a suitable thermoplastic material such as acetal, which may have a black color, substantially the same color as the gasket 144. In this way, it will be appreciated that the plurality of fastener clips 116 located along the top edge of the windshield 12 are substantially unnoticeable as compared to the stainless steel clip arrangement illustrated in FIG. 2. The trim piece 114 also has a clean, uncluttered appearance since the surface of the outside flange portion 138 is uninterrupted along its entire length.

It will be appreciated that the fastener clip described herein may be used in conjunction with other structures or vehicles where a gasket material is inserted between the trim piece and an associated glass panel, thereby providing the opportunity for attachment of the fastener clip in an unobtrusive fashion.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A trim assembly for a windshield comprising:

a trim piece extendable along an edge of the windshield;

a gasket secured within the trim piece and including a first channel for receiving the edge of the windshield and a second channel separate from the first channel; and a fastener clip releasably secured in the second channel of the gasket and including one part of a releasable fastener.

2. A trim assembly according to claim 1, wherein the first channel and the second channel initiate on a windshield side of the gasket and extend into the gasket.

3. A trim assembly according to claim 1, wherein the fastener clip comprises first and second legs disposed at an angle to each other, the first leg being insertable into the second channel in the gasket, wherein the one part of the releasable fastener is affixed to the second leg.

4. A trim assembly according to claim 3, wherein the first leg comprises a plurality of serrations on at least one side thereof.

5. A trim assembly according to claim 3, wherein the first leg comprises a plurality of serrations on both sides thereof.

6. A trim assembly according to claim 3, wherein the one part of the releasable fastener is integral with the second leg.

7. A trim assembly according to claim 1, wherein the releasable fastener is a snap assembly, and wherein the one part is one of a male part or a female part of the snap assembly.

8. A boat windshield assembly comprising:

a transparent member;

at least one trim piece extending along an edge of the transparent member;

a gasket secured within the trim piece and including a first channel for enclosing the edge of the transparent member and a second channel separate from the first channel; and a fastener clip releasably secured in the second channel of the gasket and including one part of a releasable fastener.

9. A boat windshield according to claim 8, wherein the first channel and the second channel initiate on a transparent member side of the gasket and extend into the gasket.

10. A boat windshield according to claim 8, wherein the fastener clip comprises first and second legs disposed at an angle to each other, the first leg being insertable into the second channel in the gasket, wherein the one part of the releasable fastener is affixed to the second leg.

11. A boat windshield according to claim 10, wherein the first leg comprises a plurality of serrations on at least one side thereof.

12. A boat windshield according to claim 10, wherein the first leg comprises a plurality of serrations on both sides thereof.

13. A boat windshield according to claim 10, wherein the one part of the releasable fastener is integral with the second leg.

14. A boat windshield according to claim 8, wherein the releasable fastener is a snap assembly, and wherein the one part is one of a male part or a female part of the snap assembly.

15. A top trim assembly for a windshield comprising:

a trim piece defining a gasket receiving channel;

a gasket insertable into the gasket receiving channel, the gasket comprising a first channel for enclosing the edge of the windshield and a second channel separate from the first channel; and a fastener clip including first and second legs disposed at an angle to each other, the first leg being releasably insertable into the second channel in the gasket, wherein one part of a releasable fastener is affixed to the second leg, and wherein the second leg and the one part are configured such that the one part is accessible when the first leg of the fastener clip is inserted into the second channel.

16. A top trim assembly according to claim 15, wherein the releasable fastener is a snap assembly, and wherein the one part is one of a male part or a female part of the snap assembly.

* * * * *